United States Patent [19]

Benzon

[11] 4,141,155

[45] Feb. 27, 1979

[54] METHOD AND APPARATUS FOR DRYING AND COOLING PRODUCTS OF A GRANULAR NATURE

[76] Inventor: William Benzon, 613 Bittersweet Rd., Center Valley, Pa. 18034

[21] Appl. No.: 751,291

[22] Filed: Dec. 16, 1976

[51] Int. Cl.[2] ..... F26B 3/14

[52] U.S. Cl. ..... 34/34; 34/54; 34/167; 34/174

[58] Field of Search ..... 34/167, 174, 168, 33, 34/34, 64, 65, 54

[56] References Cited

U.S. PATENT DOCUMENTS

| | | | |
|---|---|---|---|
| 759,527 | 5/1904 | Irwin | 34/64 |
| 2,474,199 | 6/1949 | Lechthaler | 34/174 |
| 2,634,673 | 4/1953 | Maho | 34/34 |
| 2,849,806 | 9/1958 | Grahek | 34/174 |
| 3,052,988 | 9/1962 | Knaust | 34/54 |
| 3,053,522 | 9/1962 | Applegate | 34/174 |
| 3,143,397 | 8/1964 | Keefe | 34/174 |
| 3,233,337 | 2/1966 | Tomlinson | 34/174 |
| 3,739,493 | 6/1973 | Nivon | 34/174 |

FOREIGN PATENT DOCUMENTS

| | | | |
|---|---|---|---|
| 2300981 | 9/1976 | France | 34/174 |

*Primary Examiner*—John J. Camby
*Assistant Examiner*—Larry I. Schwartz
*Attorney, Agent, or Firm*—Seidel, Gonda & Goldhammer

[57] ABSTRACT

Apparatus and method for drying and cooling products of a granular nature such as coal as they move downwardly through two flow paths by directing ambient air horizontally through the flow paths into a chamber between the flow paths are disclosed. The chamber is partitioned, and air flow is controlled, so that more air flows through the upper part of the chamber as compared with the lower part of the chamber.

11 Claims, 4 Drawing Figures

METHOD AND APPARATUS FOR DRYING AND COOLING PRODUCTS OF A GRANULAR NATURE

BACKGROUND

Drying apparatus typical of the prior art is exemplified by U.S. Pat. Nos. 691,209 and 1,424,565. The apparatus and method of the present invention are an improvement over the devices disclosed in said patents.

DISCLOSURE

Apparatus and method are disclosed for cooling and removing moisture from granular products such as coal or the like adapted to enter the apparatus at an elevated temperature. The products to be dried and cooled flow downwardly as a mass between parallel screens. Air at ambient temperature is caused to flow through the screens and the products to thereby cool the products and remove moisture therefrom.

Air which has flowed through the mass of products and the screens enters a chamber which is partitioned. Flow between the partitions is controlled so that the upper end of the mass of products is subjected to greater flow as compared with the products at the lower end of the mass.

It is an object of the present invention to provide apparatus for cooling and drying granular products as they descend downwardly by gravity as a mass.

It is another object of the present invention to provide apparatus for drying and cooling ore products such as coal in a manner which minimizes the generation of dust, obviates drying the coal so that it is bone dry, and provides for control of air flow through the coal as the coal descends as a mass.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
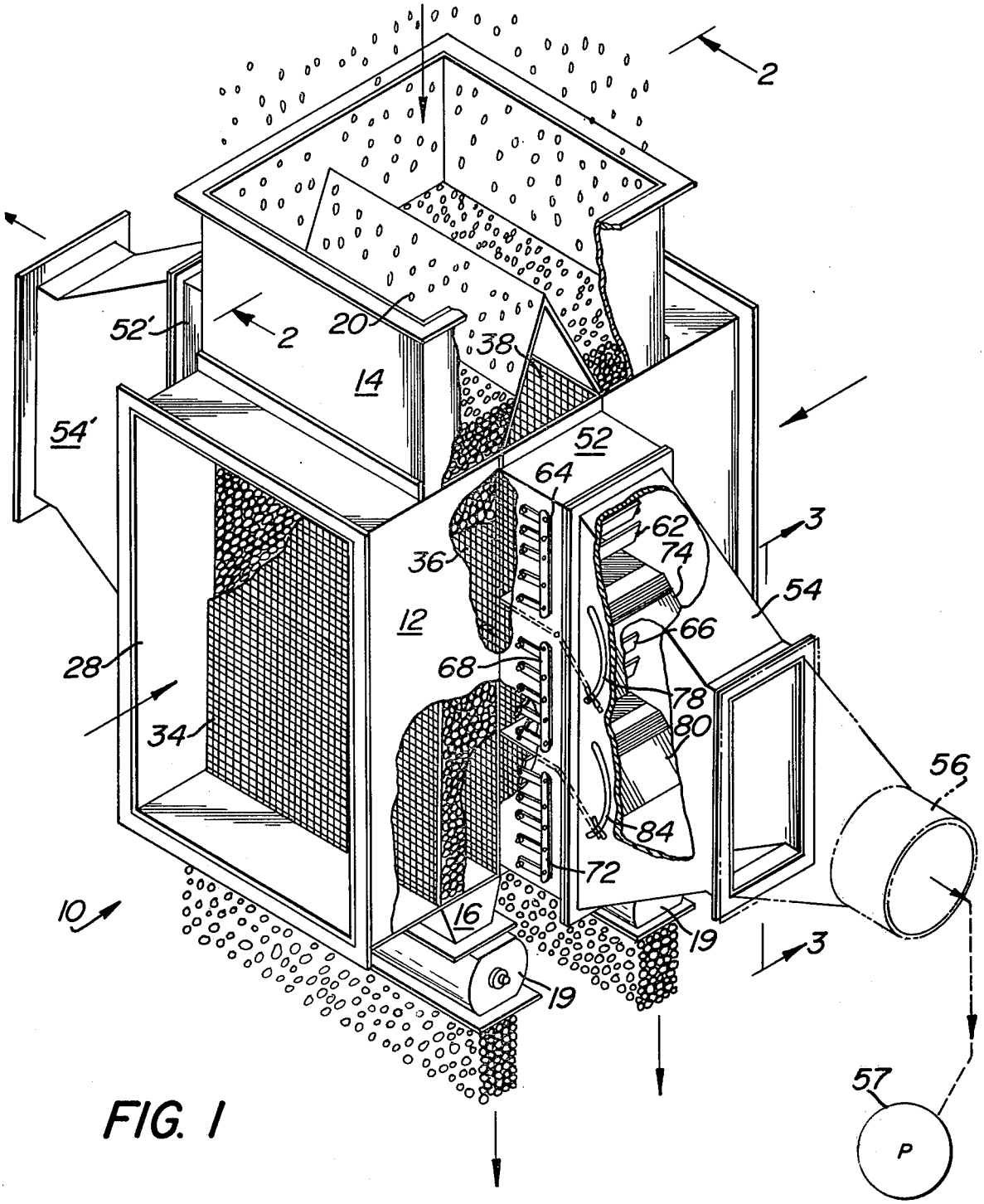
FIG. 1 is a perspective view of apparatus in accordance with the present invention with portions broken away for purposes of illustration.

Referring to the drawing in detail, wherein like numerals indicate like elements, there is shown apparatus in accordance with the present invention designated generally as 10. For purposes of illustration, the product which is being dried and cooled will be identified as coal. The apparatus 10 is structurally interrelated in the manner so that the coal descends by gravity as a mass as compared with shearing action between adjacent pieces of coal to cause them to tumble and generate dust.

The apparatus 10 includes a housing designated generally as 12. The housing 12 has a flanged inlet 14 at the upper end for introduction of the coal 22. The inlet 14 is adapted to be connected to processing equipment which elevates the temperature of the coal but results in coal having a moisture content greater than that which is desired. The apparatus 10 dries the coal to remove the undesired excess moisture and cools the coal to reduce its temperature.

The housing 12 is provided with first and second outlets 16, 18. Housing 12 includes a tapered deflector 20 at the upper end of parallel flow passages 24 and 26. Flow passage 24 is aligned with outlet 16 and flow passage 26 is aligned with outlet 18. Each of the outlets 16, 18 is provided with a constant flow feeder 19 which discharges the coal 22 onto a conveyor 21.

Figure 2:
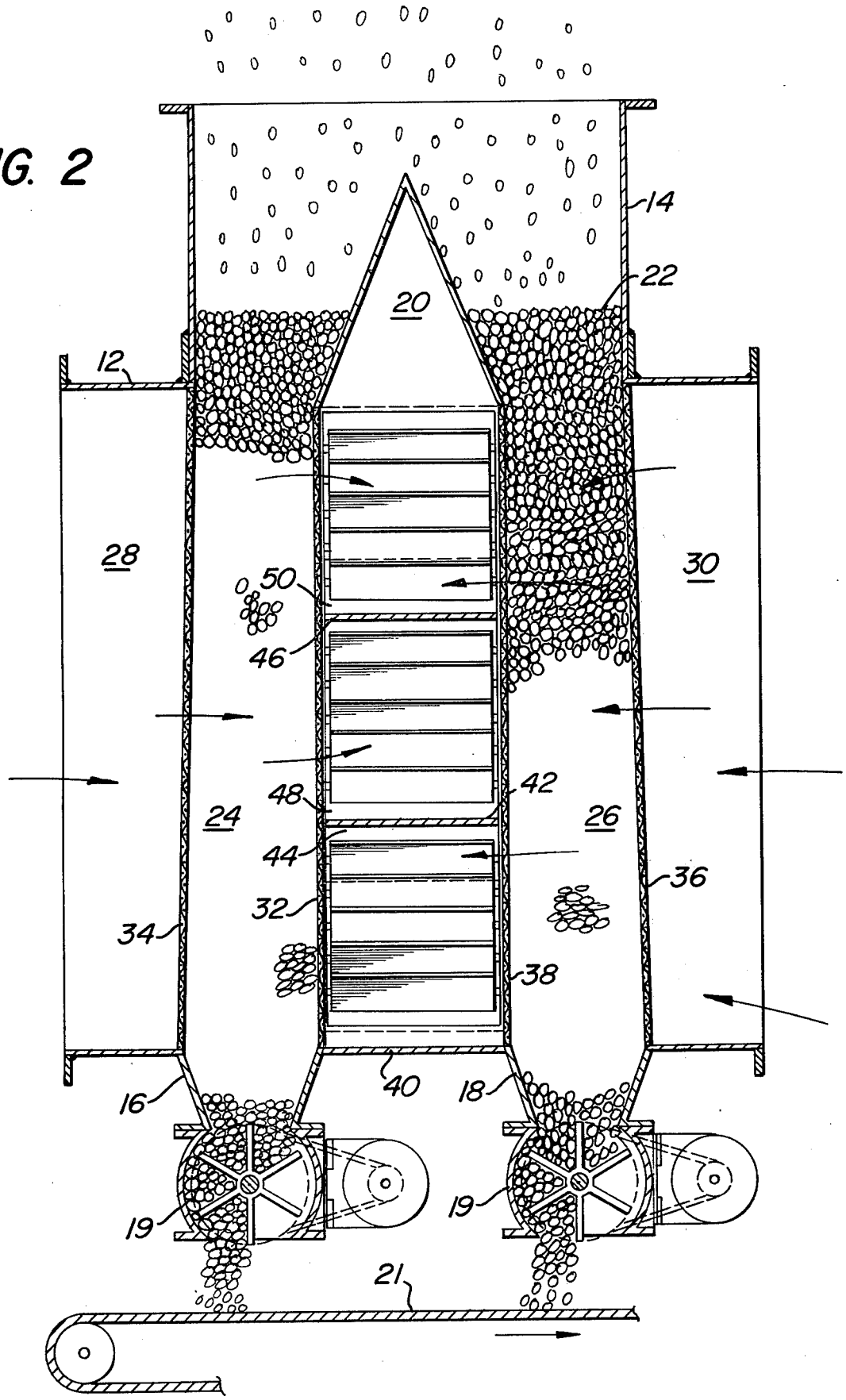
FIG. 2 is a sectional view taken along the line 2—2 in FIG. 1.
Figure 3:
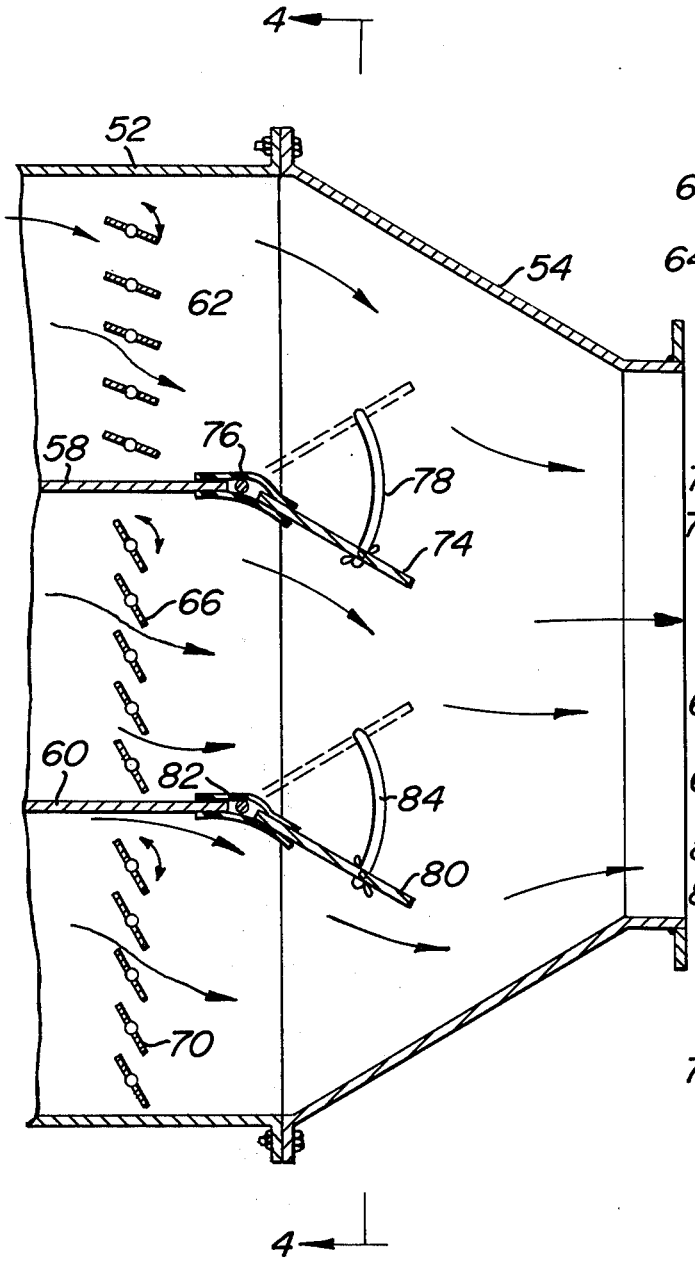
FIG. 3 is a sectional view taken along the line 3—3 in FIG. 1.
Figure 4:
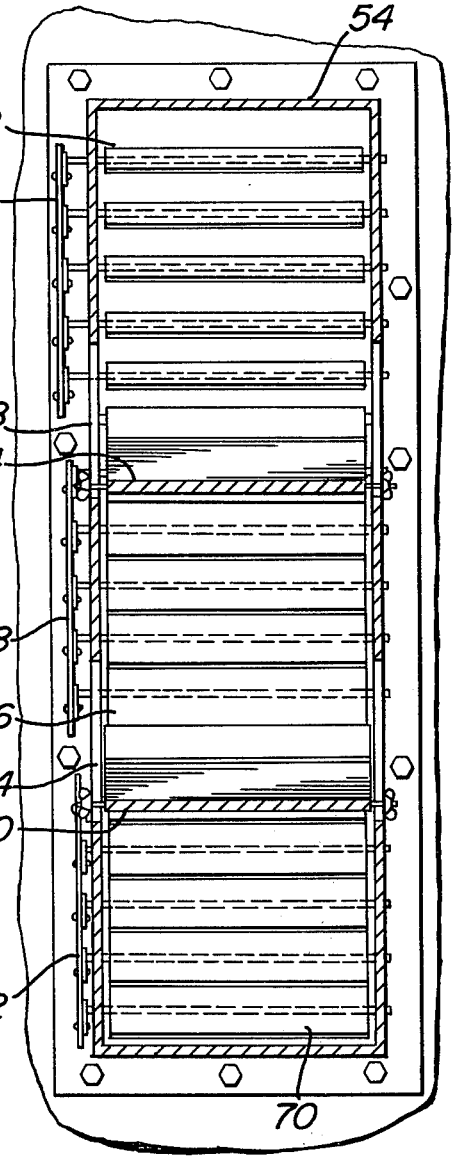
FIG. 4 is a sectional view taken along the line 4—4 in FIG. 3.

A housing 12 is preferably provided with the dual flow passages 24 and 26. Hence, housing 12 has a pair of air inlets 28 and 30 which are disposed on opposite sides of the housing. Compare FIGS. 1 and 2. Flow passage 24 is defined by an outer screen 34 associated with air inlet 28 and an inner screen 32 which is parallel to screen 34. Flow passage 26 is defined by an outer screen 36 associated with air inlet 30 and an inner screen 38. Screen 38 is parallel to screen 36. The flow passages 24 and 26 are rectangular is cross section and extend for the full width of the housing 12.

The mass of coal 22 descends downwardly through the flow passages 24 and 26 due to gravity. The screens 32–38 are preferably stainless steel wedge-bar screens having a very low coefficient of sliding friction to minimize any tendency of shearing the pieces of coal 20.

The bottom of the housing 12 is designated 40. See FIG. 2. The space between the screens 32, 38 and above wall 40 is an air removal chamber. The air removal chamber is provided with a plurality of partitions. See FIG. 2 wherein the air removal chamber includes partitions 42 and 46.

Partition 42 and bottom wall 40 cooperate to define chamber 44. Partitions 42 and 46 cooperate to define chamber 48 therebetween. Partitions 46 and deflector 20 cooperate to define a chamber 50 therebetween.

Housing 12 is provided with an extension 52 on one side and a corresponding extension 52' on the opposite side. Extension 52 is connected to a transition duct 54 which in turn is adapted to be connected to a conduit 56 communicating with a vacuum pump 57. The housing is provided with corresponding structure on the opposite side in connection with the extension 52' and transition duct 54'.

Extension 52 is provided with a partition 58 coextensive with partition 46 and a partition 60 coextensive with partition 42.

The extension 52 above the partition 58 is provided with a set of louvres 62 having a manual actuator 64 on the outer surface of the extension. See FIG. 1. Between partitions 58 and 60, there is provided a set of louvres 66 having an externally disposed actuator 68. Below the partition 60, there is provided a set of louvres 70 having an externally disposed actuator 72. Manipulation of the actuators 64, 68, and/or 72 facilitates control of flow through the respective chambers 50, 48, 44.

The transition duct 54 is provided with a damper 74 connected to the partition 58 by hinge 76. Damper 74 has an actuator extending through the arcuate slot 78 so that is may be manipulated from an external position. A damper 80 is adjustably supported on the partition 60 by a hinge 82. Damper 80 has an actuator extending through the arcuate slot 84 so that it may be manipulated externally. Each of the dampers 74, 80 has a position wherein it constitutes an extension of the partitions 58, 60 respectively. Each damper may be manipulated above and below a horizontal disposition. The upper and lower extremities of the adjustment of dampers 74, 80 facilitate further control of the flow through the chambers 40, 48, 42 and supplement the sets of louvers 62, 66 and 70.

The method of the present invention is reflected in the following description of operation of apparatus 10.

Coal 22 at an elevated temperature and a moisture content above that which is desired enters the housing 10 through the inlet 14 and separates into two masses by way of the deflector 20. The coal descends as a mass through the flow passages 24 and 26 to the feeders 19. As the coal descends downwardly as a mass, its temperature is reduced by the ambient air entering housing 12 through the inlets 28 and 30. Also, the air moving from the inlets to the chambers 50, 48, 44 reduces the moisture content to the coal 22.

As the mass of coal 22 descends, its moisture content is reduced down to about 1 to 2%. While the coal 22 is being subjected to air moving horizontally through the mass of coal in the flow passages 24, 26, the coal descends as a mass due to the low coefficient of sliding friction of the screens 32–38 and the uniform cross sectional of the flow passages 24, 26. The minor constriction of the outlets 16 and 18 has no effect on the coal 22 since the coal at this point is at its mininum moisture content and is no longer subjected to the transverse air flow.

The coal 22 has its highest moisture content and its highest temperature adjacent the upper end of the flow passages. Hence, the air flow through chamber 50 is controlled so as to exceed that flowing through chamber 48 which in turn exceeds that flowing through chamber 44. Such control is attained by manipulation of the actuators 64, 68 and 72 as well as adjustment of the dampers 74, 80. It is to be noted that the inlets 28 and 30 have a vertical height corresponding generally to the combined vertical height of the chambers 50, 48, 44. Pump 57 for evacuating the air from the chambers 58, 48, 44 may be connected to each of the transition ducts 54, 54'. It will be noted that the air flows horizontally through the flow paths 24, 26 and then makes a right angle change of direction and exits from the chambers 50, 48, 44 in a horizontal direction.

I have found that the provision of the partitions 42, 46 resulting in the discrete chambers 50, 48, 44 is very desirable. The provision of such chambers facilitates control of flow of air so that the maximum air flow is located opposite the mass of coal having the greatest temperature and moisture content. Further, I have found that resistance to air flow through the coal mass decreases as the coal losses moisture whereby less air flow is needed through chamber 44 as compared with chamber 50. While only three such chambers are illustrated, it will be appreciated that a greater or lesser number of chambers corresponding to chambers 50, 48, 44 may be provided. While the preferred embodiment removes air from the chambers 50, 48, 44 in opposite horizontally disposed directions, only one such outlet may be provided if desired. While the preferred embodiment utilizes two flow passages 24, 26, it should be apparent that the present invention may be utilized with only a single flow passage wherein extension 52 and duct 54 are directly opposite the air inlet.

The present invention may be embodied in other specific forms without departing from the spirit or essential attributes thereof and, accordingly, reference should be made to the appended claims, rather than to the foregoing specification as indicating the scope of the invention.

I claim:

1. Apparatus for drying and cooling products comprising a housing having an inlet at the upper end of a downwardly extending flow passage defined by parallel screens, said housing having an outlet communicating with the lower end of said passage, said housing having an air inlet communicating directly with at least one of said screens, said housing having an air removal chamber on the opposite side of the flow passage from the air inlet, said air removal chamber being partitioned by partitioning members to form a plurality of discrete chambers, the combined vertical height of said discrete chambers being generally equal to the height of the air inlet, conduit means for removing air from said discrete chambers, said conduit means being discrete from and communicating with each chamber, and adjustable means for independently controlling flow between the conduit means and each of said chambers, said flow controlling means being disposed in said conduit means whereby the air flow through said discrete chambers may be regulated so that the greatest air flow is through the uppermost discrete chamber.

2. Apparatus in accordance with claim 1 wherein said housing has a pair of said flow passages, said flow passages being disposed on opposite sides of said discrete chambers, said housing having a pair of said air inlets on opposite sides of the housing with each air inlet being adjacent one of said flow passages.

3. Apparatus in accordance with claim 2 wherein said conduit means communicates with an end of said discrete chambers so that air is removed from the discrete chambers in a horizontal direction perpendicular to the direction of air flow through the air inlet and flow passages.

4. Apparatus in accordance with claim 3 including a conveyor for receiving products from the flow passages, a feeder at the outlet of each flow passage for feeding products onto said conveyor.

5. Apparatus for drying and cooling ore products with ambient air comprising a housing having two generally parallel flow paths of uniform cross section, each flow path having inner and outer screens on opposite sides thereof, means on said housing defining a product inlet communicating with the upper end of said flow paths and a discrete outlet for each flow path, said housing having discrete air inlets for introduction of ambient air on each of opposite sides of the housing adjacent an outer screen of one of said flow passages, the inner screens of said flow passages being spaced apart to define opposite sides of an air removal chamber, said air removal chamber being divided into a plurality of discrete chambers by partitioning members, means including a conduit connected to said air removal chamber for removing air from said chamber in a horizontal direction generally perpendicular to said flow paths, and control means for controlling air flow from each of said discrete chambers so that air flow through one discrete chamber is independent of the air flow through another discrete chamber, said control means being disposed in said conduit.

6. Apparatus in accordance with claim 5 wherein said discrete chambers are disposed one above the other, the combined height of said discrete chambers being approximately equal to the height of said air inlets.

7. Apparatus in accordance with claim 6 wherein said control means includes a duct communicating with said discrete chambers, said duct being partitioned, and adjustable louvres between the partitions in said duct.

8. A method of cooling and drying ore products such as coal comprising the steps of introducing ore products whose temperature and moisture are to be reduced into the upper end of a housing, using gravity to move the ore products downwardly through a flow passage of uniform cross section with the ore products moving as a mass, flowing ambient air horizontally through said ore products in said flow passage as the ore products descend through the flow passage to dry and cool the ore products, and controlling flow of said ambient air so that air flow across the upper end of the flow passage is greater than the air flow across the lower end of said flow passage, including moving the ore products downwardly through parallel flow passages having an air control chamber therebetween, said step of flowing ambient air includes introducing air from opposite sides of a housing through each flow passage to said control chamber, using a control chamber having a plurality of discrete compartments one above the other, and said step of controlling the flow of air including controlling the exit of air flow through said compartments so that air flow through the upper compartment exceeds air flow through the lowermost compartment.

9. A method in accordance with claim 8 wherein the ore product is coal, using spaced parallel screens to define opposite sides of the flow path, and using air inlets having a height corresponding generally to the combined height of said compartments, and withdrawing air from said compartments in a horizontal direction perpendicular to each of the directions of air flow through the flow passages and the direction of movement of coal through the flow passages.

10. Apparatus in accordance with claim 1 wherein said flow controlling means includes a duct communicating with said discrete chambers, said duct being divided by partitions, each partition being generally coextensive with one of said partitioning members, and adjustable louvres disposed between the partitions for independently controlling the air flow in the respective discrete chambers.

11. Apparatus in accordance with claim 10 wherein said flow controlling means further includes a pivotable damper extending from each partition in the direction of said air flow.

* * * * *